United States Patent [19]

Arnold et al.

[11] 4,358,176

[45] Nov. 9, 1982

[54] BAYONET COUPLING FOR ELECTRICAL CONNECTOR

[75] Inventors: Bruce K. Arnold, El Toro, Calif. and Lawrence Schwartz, Huntington Beach, Calif.

[73] Assignee: International Telephone and Telegraph Corporation, New York, N.Y.

[21] Appl. No.: 142,351

[22] Filed: Apr. 21, 1980

[51] Int. Cl.[3] ..... H01R 13/32

[52] U.S. Cl. ..... 339/88 R; 339/218 R

[58] Field of Search ..... 339/88, 90, 145 R, 188, 339/218

[56] References Cited

U.S. PATENT DOCUMENTS

| | | | |
|---|---|---|---|
| 1,101,752 | 6/1914 | May | 339/145 R |
| 1,292,840 | 1/1919 | MacLean | 339/188 R |
| 1,630,126 | 5/1927 | Marsat | 339/145 R |
| 2,232,093 | 2/1941 | Borton | 339/188 R |
| 2,729,800 | 1/1956 | Knudsen | 339/88 C |

*Primary Examiner*—Joseph H. McGlynn

[57] ABSTRACT

A plastic electrical connector member is disclosed having bayonet pins thereon adapted to engage bayonet slots on a coupling nut of a mating connector member. The bayonet pins are formed on a metal band which surrounds the plastic body of the first connector member. The pins are hollow and filled with a molding compound which is integral with the plastic body so that movement of the bayonet pin band on the plastic body is prevented.

2 Claims, 14 Drawing Figures

BAYONET COUPLING FOR ELECTRICAL CONNECTOR

BACKGROUND OF THE INVENTION

The present invention relates to bayonet coupling for an electrical connector and, more specifically, to an electrical connector member having bayonet pins thereon.

The use of bayonet coupling arrangements in the electrical connector art is well known. Typically, a bayonet coupling nut is rotatably mounted on a shell of the plug connector member. The nut has bayonet grooves formed in its interior surface opening to the front of the nut. When the plug connector member is mated with the receptacle connector member of the assembly, bayonet pins on the receptacle shell enter the bayonet slots of the nut. Rotation of the nut draws the plug and connector members together into mating relationship.

The shells of the connector members of the typical electrical connector assembly and the coupling nut thereof, are formed of metal, and each shell contains an insulative insert in which the electrical contacts of the connector are mounted. The use of separate metal shells and insulative inserts adds to the cost of the connector, and the metal shells and coupling nut add to the weight of the connector. It is desirable for some applications to make the connector members of one-piece plastic bodies in which the contacts are mounted, thereby reducing the cost and weight of the connector. However, plastic bayonet pins on the receptacle connector member are not capable of withstanding a large number of couplings of the two connector halves due to the softness of the plastic material. U.S. Pat. Nos. 3,029,406 and 3,182,280 teach the use of plastic connector members in which individual metal bayonet pins are embedded in one of the members. However, in each case, the pins may loosen in the plastic body of the connector member after repeated couplings and uncouplings thereof with the mating connector half.

It is, therefore, the object of the present invention to mount metal bayonet pins on an insulative connector body in a manner which will overcome the disadvantages of the prior art connector arrangements disclosed hereinabove.

SUMMARY OF THE INVENTION

According to a principal aspect of the present invention, there is provided an electrical connector member which is adapted to mate with a second connector member having a bayonet coupling nut thereon. The first connector member comprises a cylindrical insulative body having a forward mating end. A metal band adjacent to the forward mating end of the body embodies at least one outwardly extending metal bayonet pin. Means is provided for restricting the band from movement rotationally and axially on the body.

Thus, by the present invention, the bayonet pins are provided on a metal band which may be rigidly fixed on an insulative connector body so that the pins are capable of withstanding a large number of couplings and uncouplings with a mating connector member without the pins becoming loose on the body on which they are mounted. Other aspects and advantages of the invention will become more apparent from the following description taken in connection with the accompanying drawings.

DESCRIPTION OF THE PREFERRED EMBODIMENTS

Figure 1:
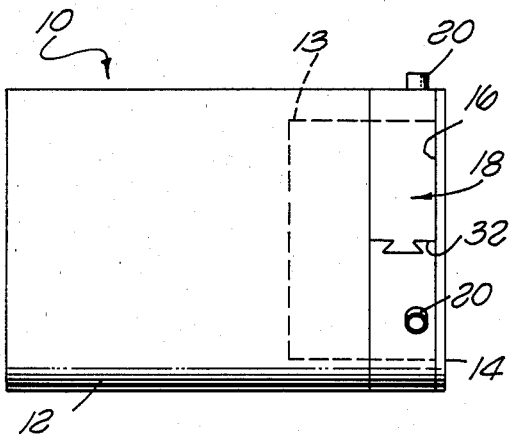
FIG. 1 is a somewhat schematic, side elevational view of a connector member embodying the bayonet pin band of the present invention.
Figure 2:
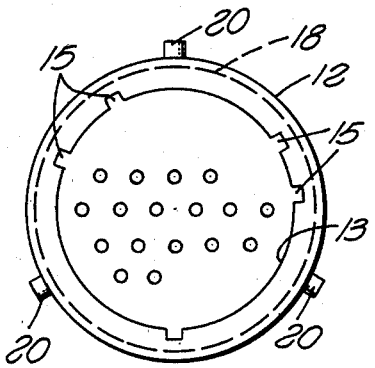
FIG. 2 is a front end view of the connector member illustrated in FIG. 1.

Referring now to FIGS. 1 and 2 of the drawings in detail, there is illustrated an electrical connector member, generally designated 10, which may be in the form of a receptacle connector member containing a plurality of contacts, not shown. The connector member comprises a cylindrical insulative body 12 having a cylindrical recess 13 opening at the forward mating end 14 of the body. Polarizing keyways 15 are formed in the wall of the recess. The body may be formed of a plastic or a high durometer elastomeric material. In this embodiment, an annular groove 16 is formed in the outer surface of the body adjacent to the forward end 14. A metal band 18 is mounted in the groove. The band embodies a plurality, three being shown by way of example, of bayonet pins 20. As seen in FIG. 2, the pins are spaced apart 120° from each other.

Figure 3:
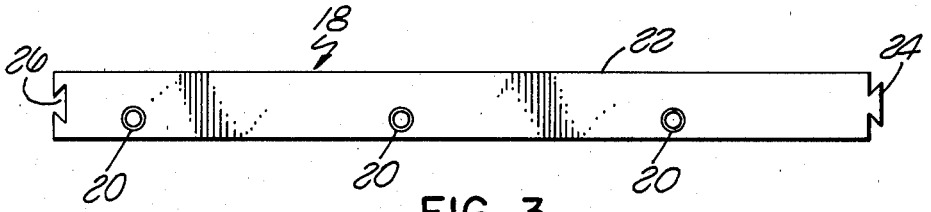
FIG. 3 shows the band in strip form before it has been rolled into a cylinder.
Figure 4:
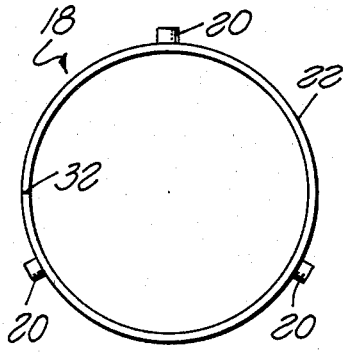
FIG. 4 is an end view of the rolled band.

The bayonet pin band is preferably formed from a strip of sheet metal 22, such as stainless steel, as shown in FIG. 3. One end of the strip is formed with a dovetail projection 24 while the other end embodies a matching dovetail recess 26.

Figure 5:
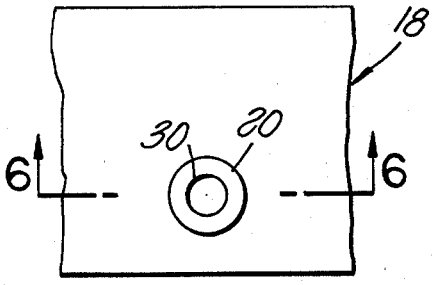
FIG. 5 is a fragmentary side view of the portion of the band in which a bayonet pin is mounted.
Figure 6:
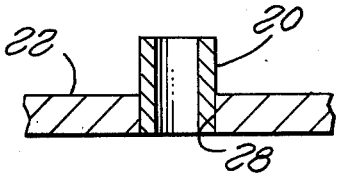
FIG. 6 is a sectional view taken along line 6—6 of FIG. 5.

As best seen in FIGS. 5 and 6, each pin 20 is in the form of a hollow cylinder which is mounted in one of the openings 28 in the strip 22. Thus, a radial opening 30 extends from the inner surface of the band to the outer end of the pin 20. The cylindrical pins 20 may be fixedly mounted in the holes 28 by press-fitting, riveting, or the like.

To assemble the band 18 to the connector body 12 the strip 22 is rolled, with the pins 20 on the outside, into a cylindrical configuration in the annular groove 16 in the connector body 12. The dovetail projection 24 is inserted into the matching recess 26 at the opposite end of the strip 22 to interlock the ends together thereby forming a joint 32. The joint may be made permanent by spot welding or the like.

Figure 7:
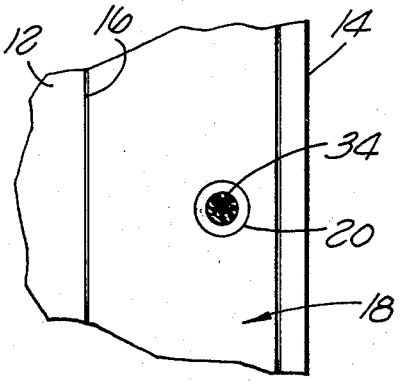
FIG. 7 is an enlarged fragmentary view of a portion of the connector illustrated in FIG. 1 showing how the band is secured on the connector body.

It is noted from FIG. 7 that the width of the groove 16 is just large enough to receive the band 18 so that the band is restricted from axial movement of the connector body. In order to prevent rotational movement of the band on the body, the openings 30 in the pins 20 are filled with a molding compound, compatible with the material of the body 12, to thereby form plugs 34 integral with the body that extend into the pins.

Figure 8:
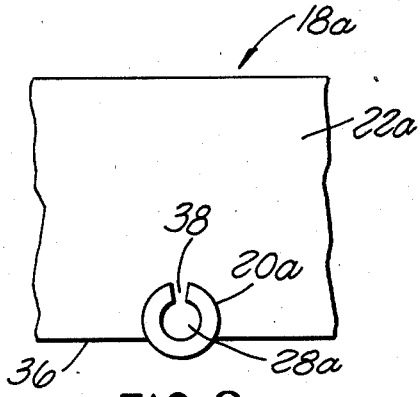
FIGS. 8 and 9 are fragmentary side and end views, respectively, of a second embodiment of the bayonet pin band of the invention.
Figure 9:
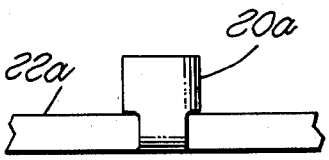

FIGS. 8 and 9 show another embodiment of the bayonet pin band, generally designated 18*a*, in which the pin is formed from a section of the strip 22*a* extending outwardly from the edge 36 and bent upwardly and rolled into a cylinder as shown at 20*a*. The cylindrical pin 20*a* embodies a longitudinal slot 38. An opening 28*a* is formed in the strip 22*a* aligned with the interior of the pin 20*a*.

Figure 10:
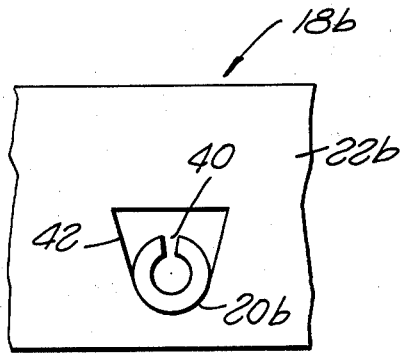
FIGS. 10 and 11 are fragmentary side and end views, respectively, of a third embodiment of the band.
Figure 11:
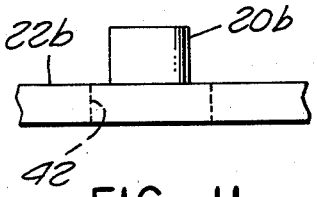

In FIGS. 10 and 11, the pin 20*b* is formed from a central section of the strip 22*b* which is stamped, bent up and rolled to form the pin. The pin 20*b* also has a longitudinal slot 40. The stamped and formed section of the strip 22*b* which forms the pin 20*b* leaves a wedge-shaped opening 42 in the strip below the pin so that the interior of the pin is open to the surface of the connector body 12 when the band 22*b* is mounted thereon.

Figure 12:
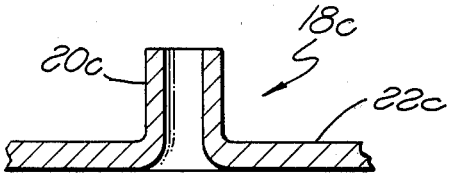
FIG. 12 is a sectional view similar to FIG. 6 showing a fourth embodiment of the band.

FIG. 12 shows another embodiment of a band 18*c* similar to band 18 except that the pin 20*c* is drawn from the strip 22*c* rather than being a separate part.

In each of the embodiments illustrated in FIGS. 8–12, the bayonet pin is an integral part of the strip which forms the band. As in the first embodiment of the invention, the interior of each bayonet pin is filled with a molding compound after mounting the band over the body 12 to prevent rotational movement of the band on the body.

In an alternative embodiment, not shown, any one of the bands illustrated in FIGS. 1–12 may be retained on the connector body by initially molding the body with outwardly extending plugs spaced apart a distance corresponding to the spacing between the bayonet pins on the band. The plugs would be dimensioned to have a sliding fit in the hollow pins. The band would be mounted over the connector body with the hollow pins thereon aligned with the plugs, and the pins would be pushed down over the plugs. Thereafter, the ends of the band would be interlocked in the manner shown in FIG. 1. By utilizing this technique, the pins on the band may have an inverted cup-shaped configuration as illustrated in FIG. 13.

In still a further embodiment of the invention, not shown, barbs may be struck from the strip of any of the bayonet pin bands described above and pushed inwardly to become embedded into the plastic body of the connector to fixedly retain the band on the body.

Figure 13:
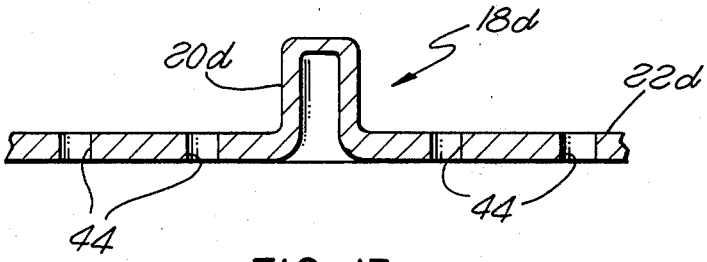
FIG. 13 is a sectional view similar to FIG. 6 showing a fifth embodiment of the band.
Figure 14:
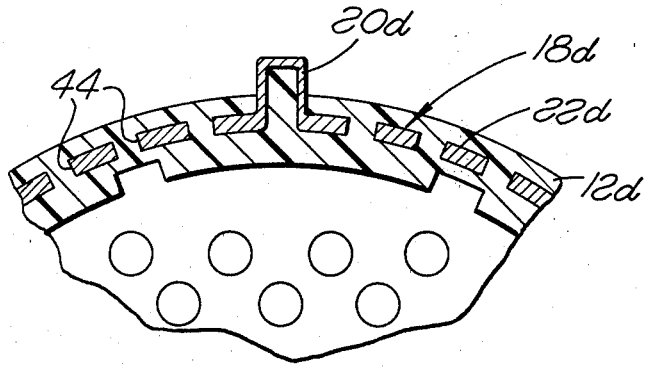
FIG. 14 is a transverse sectional view of a connector embodying the band of FIG. 13, with the section being taken through the band.

Reference is now made to FIGS. 13 and 14 wherein the bayonet pin band 18*d* comprises a strip 22*d* formed with a plurality (only one being shown) of integral, inverted cup-shaped pins 20 *d* which may be formed by a punching operation. In this embodiment, the strip 22*d* is formed with a plurality of openings 44. Rather than mounting the band in a groove formed in the connector body as in the previous embodiments disclosed herein, in this embodiment the band is formed as a ring, placed in a mold, and the insulative body 12*d* is molded around the band so that the insulation passes through the openings 44 in the band as seen in FIG. 14 whereby the band becomes securely embedded within the body. The body 12*d* is molded so that the pin 20*d* extends outwardly beyond the outer surface of the body. As will be noted, the insulation material of the body extends into the interior of the pin 20*d*.

In still a further embodiment, not shown, the bayonet pin band may be a continuous ring formed with hollow pins, as shown in FIG. 13, and inwardly and/or outwardly extending dimples. The ring may be molded into an insulative body in a manner similar to that shown in FIG. 14 so that the dimpled strip of the band will become embedded in the body.

In each of the embodiments disclosed, the molding compound which fills the interior of each bayonet pin serves not only to prevent rotation of the bayonet band on the insulative body of the connector member, but also provides additional strength to the pin itself.

What is claimed is:

1. An electrical connector member adapted to mate with a second connector member having a bayonet coupling nut thereon comprising:

a cylindrical insulative body having a forward mating end;

an annular metal band having inner and outer cylindrical surfaces, substantially all of said band being embedded in said body adjacent to said forward mating end so that the material of said body covers said inner and outer surfaces;

said band embodying at least one outwardly extending metal bayonet pin protruding beyond the outer surface of said body;

said band having openings therethrough spaced circumferentially from said bayonet pin and filled with the material of said body for restricting said band from movement rotationally and axially relative to said body, and said band being cylindrical along its entire longitudinal extent, except for said bayonet pin, so that the thickness of said cylindrical body may be maintained at a minimum.

2. An electrical connector member as set forth in claim 1 wherein:

said pin is of inverted cup-shaped configuration, the interior of said pin being filled with the material of said body.

* * * * *